US008783200B1

(12) United States Patent
Meyers

(10) Patent No.: US 8,783,200 B1
(45) Date of Patent: Jul. 22, 2014

(54) TRANSFORMABLE HULL VESSEL

(76) Inventor: Bennie Meyers, Yantis, TX (US)

( * ) Notice: Subject to any disclaimer, the term of this patent is extended or adjusted under 35 U.S.C. 154(b) by 166 days.

(21) Appl. No.: 13/588,766

(22) Filed: Aug. 17, 2012

(51) Int. Cl.
*B63B 1/22* (2006.01)
*B63B 1/32* (2006.01)

(52) U.S. Cl.
CPC ..... *B63B 1/22* (2013.01)
USPC ..... 114/284; 114/291

(58) Field of Classification Search
CPC ..... B63B 1/22; B63B 39/06
USPC ..... 114/283, 284, 285, 286, 271, 288, 290, 114/291, 292
See application file for complete search history.

(56) References Cited

U.S. PATENT DOCUMENTS

| | | | | | |
|---|---|---|---|---|---|
| 1,805,131 | A | | 6/1928 | Donaldson | |
| 2,985,130 | A | | 5/1961 | Jacobs et al. | |
| 3,076,204 | A | | 2/1963 | Nowak, Jr. | |
| 3,120,210 | A | | 2/1964 | Molotzak | |
| 3,270,701 | A | | 9/1966 | Kubas | |
| 3,308,780 | A | * | 3/1967 | Abramson | 114/283 |
| 3,437,067 | A | | 4/1969 | Malin | |
| 3,559,222 | A | | 2/1971 | Walker | |
| 3,625,173 | A | | 12/1971 | Mitton | |
| 3,807,337 | A | | 4/1974 | English et al. | |
| 3,885,514 | A | | 5/1975 | Lauenborg | |
| 3,938,458 | A | | 2/1976 | Irgens | |
| 3,998,176 | A | * | 12/1976 | Stout et al. | 114/283 |
| 4,004,534 | A | | 1/1977 | Allison | |
| 4,091,761 | A | | 5/1978 | Fehn | |
| 4,165,703 | A | | 8/1979 | Burg | |
| 4,348,972 | A | | 9/1982 | Parsons | |
| 4,351,262 | A | | 9/1982 | Matthews | |
| 4,458,622 | A | * | 7/1984 | Anderson | 114/284 |
| 4,494,477 | A | | 1/1985 | Matthews | |
| 4,535,712 | A | | 8/1985 | Matthews | |
| 4,538,538 | A | | 9/1985 | Carbonel | |
| 4,690,094 | A | | 9/1987 | Taylor | |
| 4,926,771 | A | | 5/1990 | Hull | |
| 5,218,918 | A | | 6/1993 | Cline | |
| 5,237,947 | A | | 8/1993 | Manning | |
| 5,390,623 | A | * | 2/1995 | Mackaness | 114/282 |
| 5,474,014 | A | | 12/1995 | Russell | |
| 6,044,784 | A | | 4/2000 | Gee et al. | |
| 6,158,376 | A | | 12/2000 | Vorus | |
| 6,216,622 | B1 | | 4/2001 | Lindstrom et al. | |
| 6,619,224 | B1 | | 9/2003 | Syfritt | |
| 6,708,642 | B1 | | 3/2004 | Taylor | |
| 6,837,176 | B1 | | 1/2005 | Rogerson | |
| 6,895,883 | B2 | | 5/2005 | Coles | |
| 6,925,953 | B1 | | 8/2005 | Batista et al. | |
| 7,146,925 | B1 | | 12/2006 | Wilkie | |
| 7,207,285 | B2 | | 4/2007 | Maloney et al. | |

(Continued)

*Primary Examiner* — Stephen Avila
*Assistant Examiner* — Anthony Wiest
(74) *Attorney, Agent, or Firm* — Goldstein Law Offices, P.C.

(57) ABSTRACT

A system for transforming a vessel hull to adjust to changing water conditions, changing the hull configuration to adapt to rough water, shallow water, a different draft or speed. The system transforms the vessel hull from a first configuration to another configuration by selectively pneumatically raising and lowering a plurality of integral sponsons that form the hull within seconds without removing the vessel from the water, even with the vessel underway. The system accommodates a multiplicity of engine designs, such as an outboard motor, a motor in a recessed position, a airboat motor or twin engines. A plurality of pneumatic cylinders that raise and lower the integral sponsons are controlled by a controller such as a PLC (Programmable Logic Control) located at a helm of the vessel.

18 Claims, 15 Drawing Sheets

(56) References Cited

U.S. PATENT DOCUMENTS

| | | | |
|---|---|---|---|
| 7,231,880 | B2 | 6/2007 | Schmidt et al. |
| 7,434,525 | B2 | 10/2008 | Hodge |
| 7,448,927 | B2 | 11/2008 | Brown et al. |
| 7,540,252 | B2 | 6/2009 | Carbonel |
| 8,065,970 | B2 | 11/2011 | Sorrentino |
| 2002/0096098 | A1 | 7/2002 | Kingsbury |
| 2006/0260527 | A1 | 11/2006 | Ackerbloom |
| 2009/0178602 | A1 | 7/2009 | Gundersen |
| 2010/0000454 | A1 | 1/2010 | Grenestedt |
| 2010/0024707 | A1 | 2/2010 | Curatolo |
| 2010/0269747 | A1 | 10/2010 | Hansen et al. |

* cited by examiner

TRANSFORMABLE HULL VESSEL

TECHNICAL FIELD

The present disclosure relates generally to a transformable hull vessel. More particularly, the present disclosure relates to a system of transforming a vessel hull from a first configuration to another configuration depending on a plurality of desired vessel operating characteristics.

BACKGROUND

A hull is the watertight body of a vessel such as a ship or a boat. The structure of the hull varies depending on the vessel type. Functionally, vessel hulls can be divided into two categories: planing and displacement. When a person purchases a vessel, the main design consideration is usually dictated by where and how the vessel will be used.

The difference between the two is where the vessel rides in the water when under moderate to maximum power. A displacement hull rides in the water, supported exclusively or predominantly by buoyancy. A displacement hull is not designed for high speed but rather travels through the water at a limited rate, which is defined by the waterline. They are often heavier than planing types, though not always. For example, many sailboats, shrimp boats, or tankers have a displacement hull.

A planing type hull rides on the water such a ski boat, race boat and most "sport fishing boats." The planing hull form is configured to develop positive dynamic pressure so that its draft decreases with increasing speed. The dynamic lift reduces the wetted surface and therefore also the drag. Planing hulls are more efficient at higher speeds, although they still require more energy to achieve these speeds. Planing hull design configurations include those generally referred to as a flat bottom, a Vee-(or V-)bottom, tunnel or V-tunnel hulls.

Flat bottom vessels have the least draft and adapt well to floating in very shallow water. However the flat bottom design becomes very uncomfortable when the vessel is planing in rough water. A vessel of the vee-hull design (or V-hull) offers a more comfortable ride in rough water because it can cut through the waves. However, when at rest, the V-hull configuration requires more draft and is less stabile, pitching and rolling more than any other hull design. Vessels of the tunnel hull design have a longitudinal channel under the hull. The purpose of this channel can be to entrap air and compress it to cushion the ride in rough water or allow the motor and propeller to be raised so the vessel can be operated in shallow water. However, the tunnel hull has some of the disadvantages of the flat bottom designs, such as an uncomfortable ride in rough water. Whenever a person buys a planing hull vessel, a decision must be made as to which hull design would be the most advantageous for the conditions usually encountered when operating the craft, choosing between stability at rest and the smoothest ride under power.

Planing vessels are often powered by one or more outboard motors that are aft-mounted, a single engine centrally positioned, or a pair of twin engines symmetrically placed aft. However, other motor positions are possible such as a recessed position. Another type of planing vessel is an airboat that is powered by topside motor that powers a powerful topside propeller that produces a rearward column of air that propels the airboat forward.

It is often desirable to have a design that is more adaptable to different boating situations. Vessels generally are manufactured with a fixed hull. Some add attachments on to the existing fixed hull structure and other fixed design modifications that are not contemporaneously adaptable. One proposal is to have hinged slats that can be repositioned by vacuum. Others have created a thick layer of air bubbles under the aft section to reduce drag without transforming the hull. Others allow for switching from outboard to airboat.

While these units may be suitable for the particular purpose employed, or for general use, they would not be as suitable for the purposes of the present disclosure as disclosed hereafter. Others lift the stern to change from displacement to planing mode. Most require that any changes to the hull must be made with the vessel out of the water.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a system for transforming a vessel hull to adjust to a changing water conditions. Accordingly, an example embodiment in the present disclosure provides a system that transform a vessel hull from a first configuration to a second hull configuration, changing the hull design to adapt to rough water, shallow water, a different desired draft or a different desired speed, the user selecting on demand the hull configuration that is best suited to the water conditions.

Another aspect of an example embodiment in the present disclosure is to provide a system for transforming a vessel hull to another configuration rapidly. Accordingly, an example embodiment in the present disclosure provides a system that transform a vessel hull from a first configuration to another configuration by selectively pneumatically raising and lowering a plurality of integral sponsons that form the hull within seconds, substantially instantly, without removing the vessel from the water, the user changing the hull configuration even with the vessel underway.

A further aspect of an example embodiment in the present disclosure is to provide a system for transforming a vessel hull that accommodates a multiplicity of engine designs. Accordingly, an example embodiment in the present disclosure provides a system that transforms a vessel hull having a multiplicity of engine designs such a outboard motor, a motor in a recessed position, a airboat motor or twin engines by selectively raising and lowering a plurality of integral sponsons that form the hull to accommodate any motor design.

Yet another aspect of an example embodiment in the present disclosure is to provide a system for transforming a vessel hull that is controlled from a helm of the vessel. Accordingly, an example embodiment in the present disclosure provides a system of integral sponsons that selectively transform a vessel hull through a plurality of pneumatic cylinders controlled by controller such as a PLC (Programmable Logic Control) located at a helm of the vessel.

A further aspect of an example embodiment in the present disclosure it to provide a user the opportunity to acquire a vessel without having to choose a fixed hull design without compromising as to which design would be the most beneficial most of the time and accepting the non-optimal consequences when boating in other conditions. Accordingly, an example embodiment in the present disclosure provides a system of integral sponsons that selectively transforms a vessel hull into an optimal hull configuration for the conditions as they change: flat bottom for stability and shallow draft, tunnel hull for operations in shallow water and V-hull in rough water conditions, the user selecting the hull design best suited for the current conditions transforming the hull quickly while the vessel is underway.

The present disclosure describes a system for transforming a vessel hull to adjust to changing water conditions, changing the hull design to adapt to rough water, shallow water, a different draft or speed. The system transforms the vessel hull from a first configuration to another configuration by selectively pneumatically raising and lowering a plurality of integral sponsons that form the hull within seconds without removing the vessel from the water. The system accommodates a multiplicity of engine designs, such as an outboard motor, a motor in a recessed position, an airboat motor or twin engine. The system selectively transforms a vessel hull into an optimal hull configuration for the conditions as they change: flat bottom for stability and shallow draft, tunnel hull for operations in shallow water and V-hull in rough water conditions, the user selecting the hull design best suited for the current conditions transforming the hull quickly while the vessel is underway. A plurality of pneumatic cylinders that raise and lower the integral sponsons are controlled by a controller such as a PLC (Programmable Logic Control) located at a helm of the vessel. The system of sponsons and pneumatic cylinders additionally provide a more cushioned ride.

The present disclosure addresses at least one of the disadvantages explained hereinabove. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
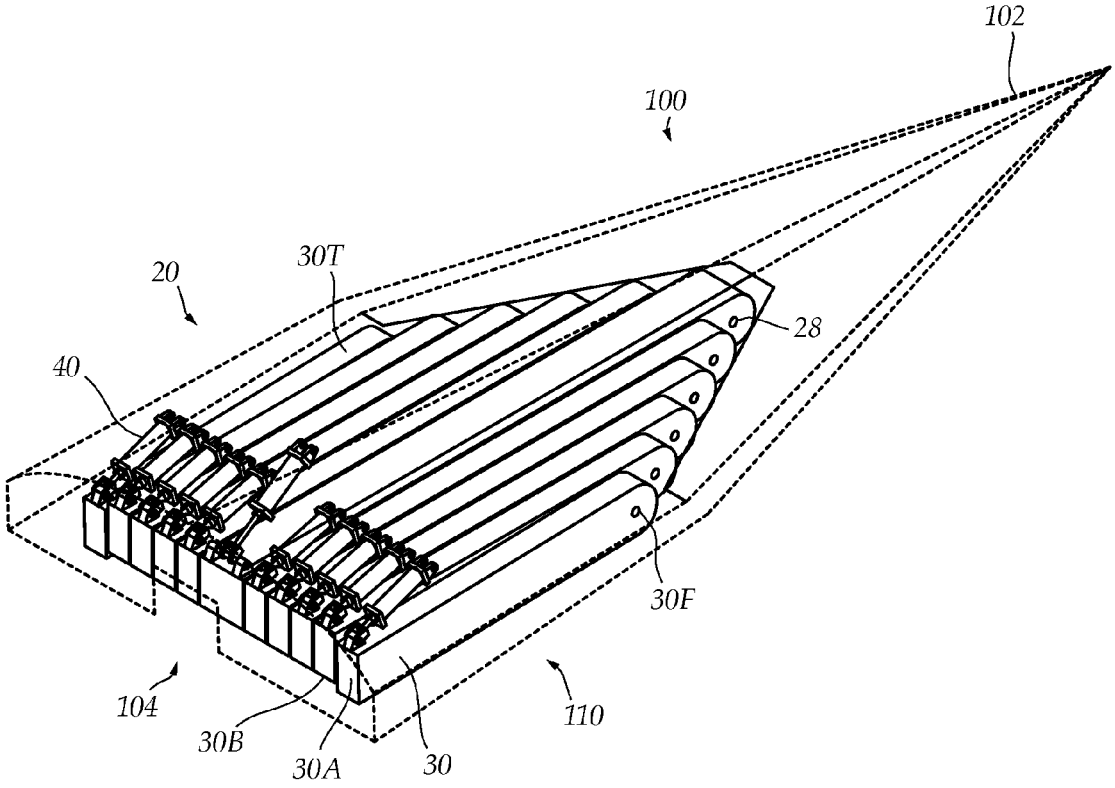
FIG. 1 is a perspective view of a vessel, shown in outline, with a plurality of sponsons forming a flat bottom hull.

FIG. 1 illustrates a vessel 100 with a hull 110, a fore portion 102 and an aft portion 104, shown in outline, provided with a system 20 for transforming a configuration of the hull of the vessel. The vessel is shown in a first configuration, the hull in a flat bottom hull configuration. The system 20 has a plurality of integral sponsons 30 forming a flat bottom hull. The system has a plurality of pneumatic cylinders for selectively raising upwardly and lowering downwardly the sponsons, each sponson is positioned by at least one pneumatic cylinder 40, moving it to one or more alternate positions that, in conjunction with the repositioning of the other sponsons, transforms the hull to one of the other desire configurations, such a V-hull, a tunnel hull or tunnel V-hull. The system 20 has a controller to signal the cylinders to raise and lower the sponsons into the desired configuration.

The pneumatic cylinders are controlled by a controller that signals the cylinders to extend or retract to a selected position. A user rapidly changes the configuration of the hull by selecting the desired configuration through the controller, the controller signaling the movement of the sponsons substantially instantly, even while the vessel is moving through the water.

The vessel described herein is generally a planing vessel, that is, a vessel that rides on the water. However, it is understood by those of ordinary skill that the system described herein is adaptable to displacement hull vessels or a planing hull operating in a displacement mode. It is further understood by those of ordinary skill that the system described herein is not limited to vessels having outboard motors but is adaptable to vessels having other propulsion systems such as, for example, but not limited to, an inboard motor; such adaptions are within the inventive concept and are contemplated as being a part of the present disclosure.

An integral sponson 30 is generally oblong, having an elongated shape with a long dimension having an aft end 30A and a fore end 30F parallel to the fore 102 and the aft 104 of the vessel. In this embodiment, the sponson has a substantially flat bottom portion 30B. When the plurality of sponsons are in place, with the aft end of each contiguous to each other and the long dimension of each parallel to each other, the flat bottom portions of the sponsons form the aft portion of the hull 110.

The fore end 30F of each sponson is hingedly connected by a hinge 28 to the fore portion of the hull. Connected to the aft end 30A of each sponson, each sponson having a top portion 30T, is at least one pneumatic cylinder 40. The pneumatic cylinder is connected to the top portion at the aft end 30A of the sponson. The at least one cylinder when retracted raises the sponson and when extended lowers the sponson. The cylinder 40 is controlled by controller such as, for example, a microprocessor or a PLC (programmable logic controller) that signals each cylinder to raise or lower each sponson to a selected position, the position selected to transform the hull to the desired configuration. Pneumatic cylinders respond rapidly to signals such that the movement of the sponsons into a different configuration is substantially instantaneous. The pneumatic cylinder, the microprocessor and the PLC are well known to those of ordinary skill and the controller is not specifically illustrated to simplify the drawings. The controller is in an easily accessible location at a helm on the vessel along with other instruments and controllers useful for piloting the vessel.

Figure 2:
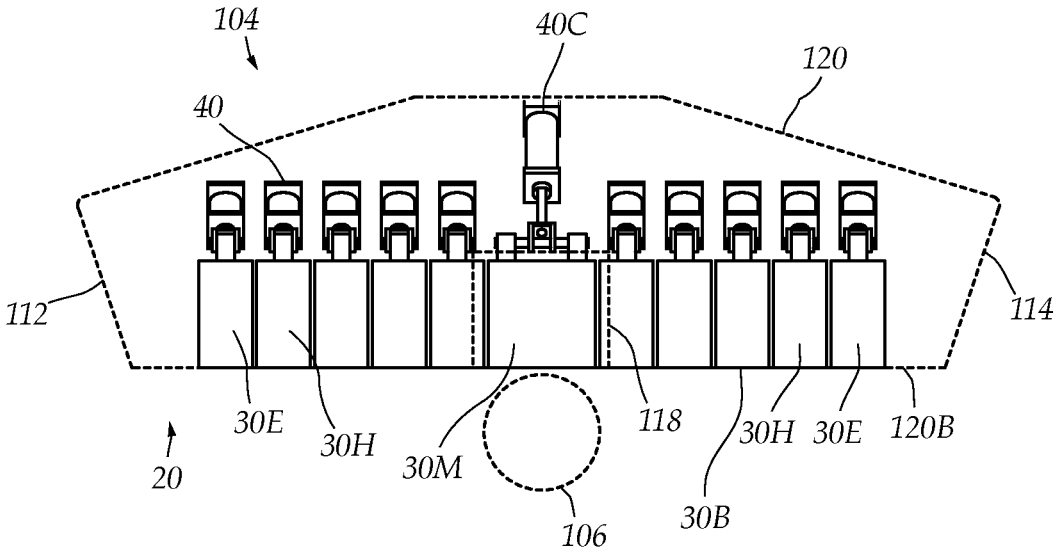
FIG. 2 is a rear elevational view of a vessel transom, shown in outline, with the sponsons forming the flat bottom hull.

FIG. 2 shows in detail the positions of the sponsons forming a flat bottom hull. A transom 120 is shown in outline, the transom forming the aft end 104 of the vessel. The vessel has a pair of sides, a port side 112 and a starboard side 114. Shown below the transom in this configuration is a circle in outline representing the position of a propeller 106 of the vessel. This example embodiment of the system 20 is for a single engine vessel with a center propeller.

In this example embodiment, there is a pair of end sponsons 30E, a sponson on the port side 112 and a sponson on the starboard side 114. The transom has a bottom edge 120B and a tunnel opening 118. Inside the tunnel opening is a center sponson 30M. Between each end sponson and the center sponson there is at least one intermediate sponson 30H, a number of sponsons between the port side sponson and the center sponson equally the number of sponsons between the starboard side sponson and the center sponson.

In the flat bottom hull configuration shown in FIG. 2, the bottom of the end sponsons 30E, the center sponson 30M and the intermediate sponsons 30H are in the same plane with the bottom edge 120B of the transom, forming the flat bottom hull. The pneumatic cylinders 40 attached to the end sponsons 30E and intermediate sponsons 30H are fully retracted, positioning said sponsons in a maximum raised position. In this embodiment, a center pneumatic cylinder 40C, having a three-position cylinder, attaching to the center sponson 30M, is in a partially extended position, extending sufficiently so that the bottom of the center sponson is in the same plane as the bottom of the remaining sponsons. The center pneumatic cylinder 40C is positioned so that when the cylinder is fully retracted, the center sponson 30M raises above the tunnel opening 118 as described hereinbelow. It is understood by those of ordinary skill, that a three-position cylinder is not a limitation and that a cylinder capable of a plurality of positions is possible within the concepts disclosed herein.

Figure 5:
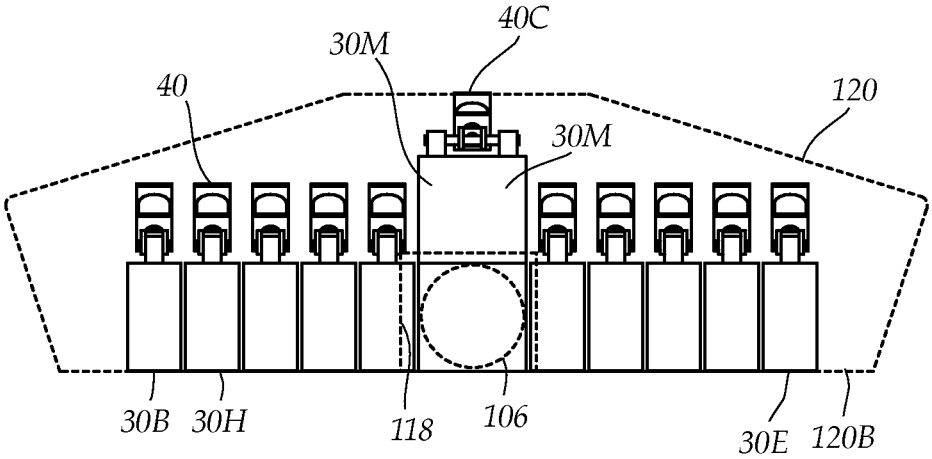
FIG. 5 is a rear elevational view of the vessel transom, shown in outline, with the sponsons forming a tunnel hull.

FIG. 5 shows the hull transforming into a tunnel hull configuration. The center pneumatic cylinder 40C is fully retracted, raising the center sponson 30M above the tunnel opening 118 in the transom 120, forming the tunnel hull configuration. The propeller 106, shown in outline, now is inside the tunnel opening. The pneumatic cylinders 40 attached to the end sponsons 30E and intermediate sponsons 30H are fully retracted and in the same plane with the transom bottom edge 120B as in the flat bottom hull configuration.

Figure 4:
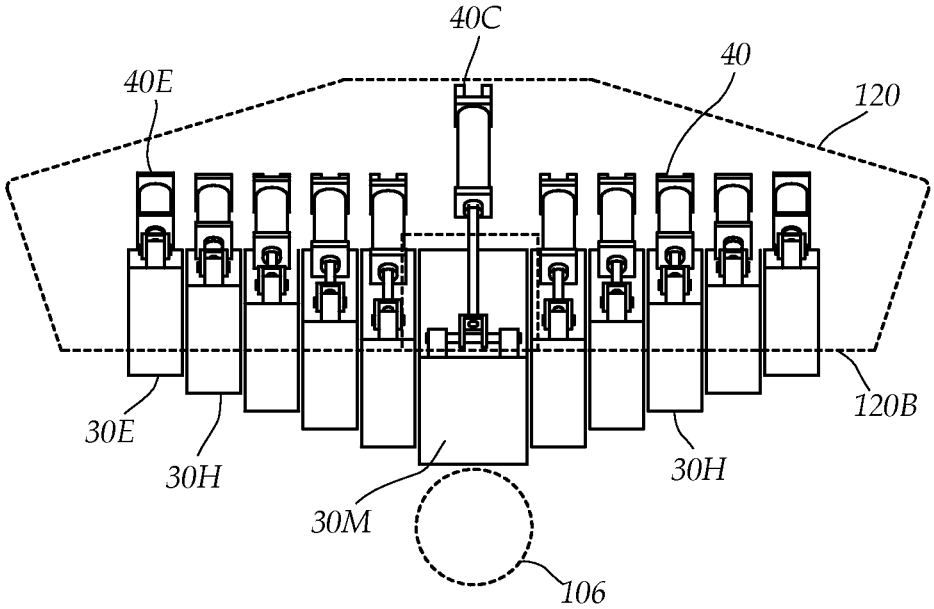
FIG. 4 is a rear elevational view of the vessel transom, shown in outline, with the sponsons forming a V-hull.

FIG. 4 shows the hull transforming into a V-hull configuration. The center pneumatic cylinder is fully extended, lowering the center sponson 30M below the bottom edge 120B of the transom 120. The pneumatic cylinders 40 attached to the end sponsons 30E and to the intermediate sponsons 30H are extended in a staggered manner, such that the end sponsons slightly extend below the bottom edge 120B of the transom, the intermediate sponsons 30H adjacent to the end sponsons extend below the transom bottom edge 120B slightly below the end sponsons. The closer the intermediate sponson 30H is to the center sponson, the greater the intermediate sponson 30H extends below the transom bottom edge. The staggered manner forms a pair of sloped sides of the V-hull below the transom bottom edge 120B. Accordingly, the pneumatic cylinders attached to the end 30E and intermediate sponsons 30H extend in the same staggered manner, the end cylinders 40E extending the least. Each intermediate cylinder 40 extends an additional amount; the closer the intermediate cylinder is to the center cylinder 40C, the greater the extension of the intermediate cylinder 40.

The center sponson extends the farthest below the transom bottom edge, forming a peak of the V-hull, connecting the sloped sides of the V-hull, the pneumatic cylinder of the center sponson fully extended. Below the center sponson 30M is the propeller 106 of the engine of the vessel, the propeller moving downward with the sponson. The on-board controller, which is not illustrated, directs the pneumatic cylinders to extend and adjusts the extension so that sponsons move into the V-hull formation.

FIG. 5 shows the hull transforming into a tunnel hull configuration. The controller signals the pneumatic cylinders 40 to fully retracted. The bottoms 30B of the end sponsons 30E and the intermediate sponsons 30H are in the same plane with the bottom edge 120B of the transom 120, in positions similar to the flat bottom hull configuration. The pneumatic cylinder attached to the center sponson 30M is fully retracted, pulling the center sponsor up above the tunnel opening 118, so that the sponson clears the tunnel opening. The vessel is now in the tunnel hull configuration. The propeller 106 moves upwardly into the tunnel opening.

Figure 3:
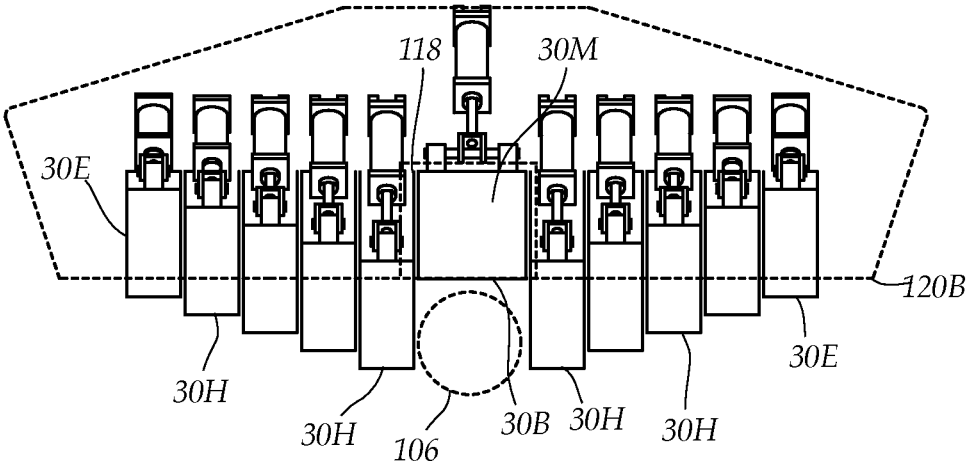
FIG. 3 is a rear elevational view of the vessel transom, shown in outline, with the sponsons forming a tunnel V-hull.

FIG. 3 shows the hull transforming into a tunnel V-hull configuration. The end sponsons 30E and intermediate sponsons 30H extend below the transom bottom edge 120B in a staggered manner as described hereinabove, forming the sloped sides of the V-hull. The center sponson 30M is in a partially retracted position, the sponson 30M in the tunnel opening 118, the bottom 30B of the sponson in the same plane as the bottom edge 120B of the transom. The propeller 106 is below the plane of the transom bottom edge 120B, similar to the position of the propeller in the flat bottom hull configuration. However, the pair of intermediate sponsons 30H' adjacent to the center sponson now form a tunnel opening for the propeller.

In FIG. 12, FIG. 13, FIG. 7, FIG. 8 and FIG. 9, the sponsons are shown without the attached pneumatic cylinders to simplify the illustrations.

Figure 12:
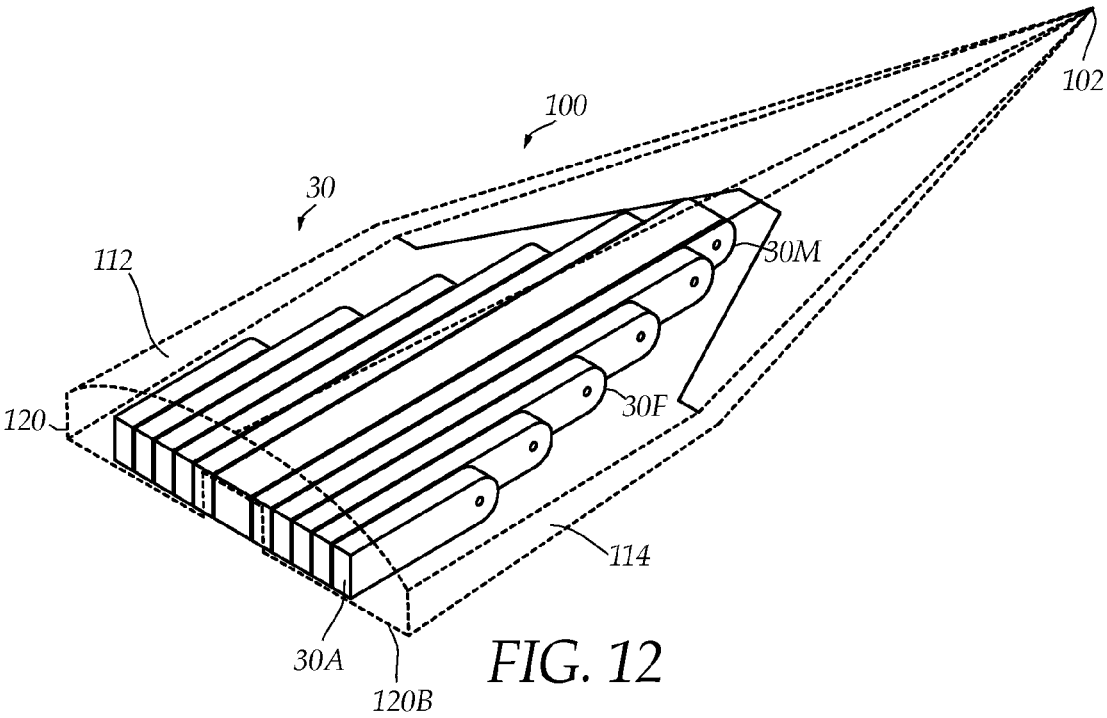
FIG. 12 is a perspective view of the vessel shown in outline with the sponsons forming a flat bottom hull.

FIG. 12 shows the vessel 100 in outline with the sponsons in the flat hull configuration. The sponsons are placed in an arrangement that conforms to the outline of the vessel. In the vessel that has a pointed fore 102, the center sponson 30M is longest and extends towards the fore 102, the fore ends 30F of the remaining sponsons 30 conforming to the shape of the sides 112, 114 of the vessel. The aft ends 30A of the sponsons are in the same plane as the transom 120. In other vessel shapes, the sponsons are arranged to conform to the vessel, with the fore end 30F of the sponsons extending to conform to the shape of the vessel and the aft ends in the same plane as the transom. FIG. 12 shows the bottom of the sponsons in the same plane as the bottom edge 120B of the transom in the flat hull configuration.

Figure 13:
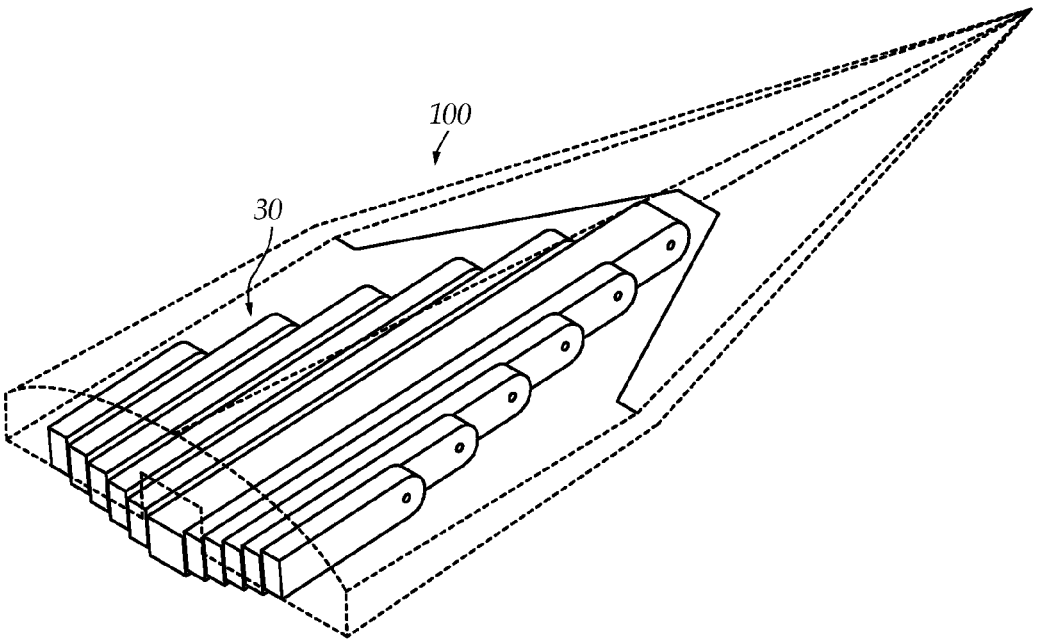
FIG. 13 is a perspective view of the vessel shown in outline with the sponsons forming a V-hull.

FIG. 13 shows the vessel 100 in outline with the sponsons in the V-hull configuration. The sponsons 30 are configured in the staggered manner as explained hereinabove.

Figure 7:
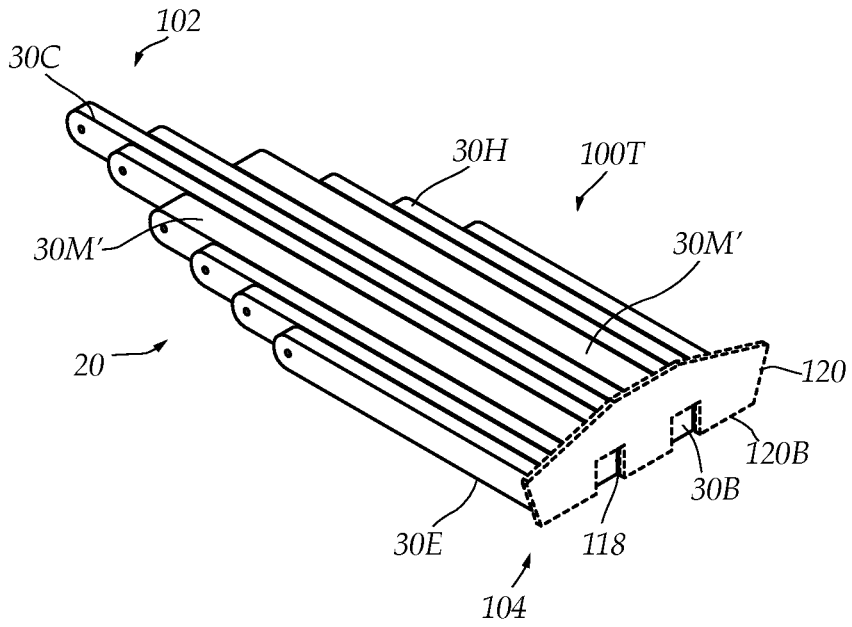
FIG. 7 is a perspective view of a vessel transom designed for a twin-engine vessel, shown in outline, the sponsons forming the flat bottom hull.

FIG. 7 shows a further example embodiment of the system. The system is configured for a twin-engine vessel 100T, the vessel having a pair of engines located with a pair of propellers at the aft 104. The transom 120 has a pair of tunnel openings 118. The system has a pair of tunnel sponsons 30M', the aft ends of the sponsons at the tunnel openings. In the drawing, the sponsons are positioned to conform to the shape of the vessel, which in the illustration, is a vessel with a pointed fore 102. The tunnel sponsons have pneumatic cylinders (not shown) positioned so that when the cylinders are retracted, the tunnel sponsons are raised to clear the tunnel openings in the transom. In the illustration, the twin-engine vessel is in the flat bottom hull configuration, with the bottoms of the sponsons in the same plane as the bottom edge 120B of the transom 120. The pneumatic cylinders attached to the middle sponson 30C, the intermediate sponsons 30H and the end sponsons 30E are fully retracted as explained hereinabove. The pneumatic cylinders attached to the tunnel sponsons are partially retracted so that the bottom 30B of the tunnel sponson is in the same plane as the transom bottom edge 120B.

Figure 8:
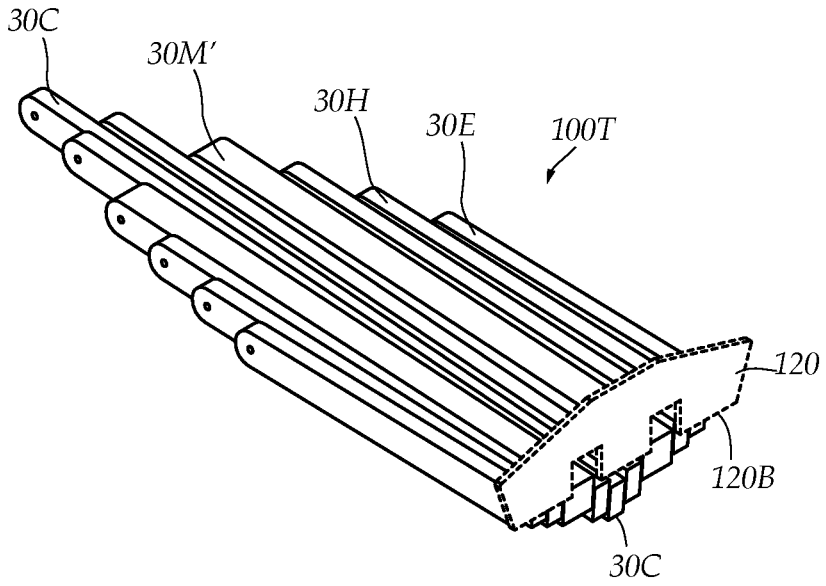
FIG. 8 is a perspective view of the vessel transom designed for the twin-engine vessel, shown in outline, the sponsons forming the V-hull.

FIG. 8 shows the twin engine vessel 100T transformed to a V-hull configuration. The middle sponson 30C extends below the bottom edge 102B of the transom. The end sponsons 30E extend slightly below the transom bottom edge 120B. The intermediate sponsons 30H including the tunnel sponsons 30M' extend in a staggered manner. The intermediate sponsons 30H adjacent to the end sponsons 30E extend below the transom bottom edge 120B slightly below the end sponsons. The closer the intermediate sponson 30H and the tunnel sponson 30M' is to the middle sponson 30C, the greater the intermediate sponson and the tunnel sponson extend below the transom bottom edge. The staggered manner forms the sloped sides of the V-hull below the transom bottom edge 120B. The pneumatic cylinders attached to the sponsons are partially to fully extended as described hereinabove.

Figure 9:
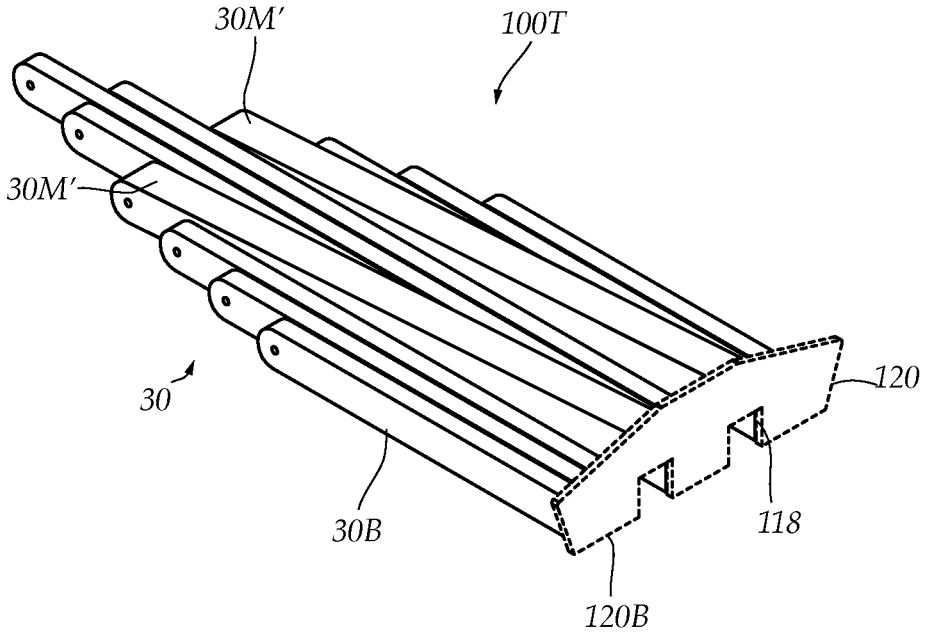
FIG. 9 is a perspective view of the vessel transom designed for the twin-engine vessel, shown in outline, the sponsons forming the tunnel hull.

FIG. 9 illustrates the twin-engine vessel in a twin tunnel hull configuration. The pair of tunnel sponsons 30M' are raised so that the bottom of the sponsons 30M' clear the tunnel openings in the transom. The bottom 30B of the remaining sponsons 30 are in the same plane as the bottom of the transom edge 120B. The pneumatic cylinders attached to the center sponsons are fully retracted, raising the tunnel sponsons 30M' as described hereinabove.

Figure 6:
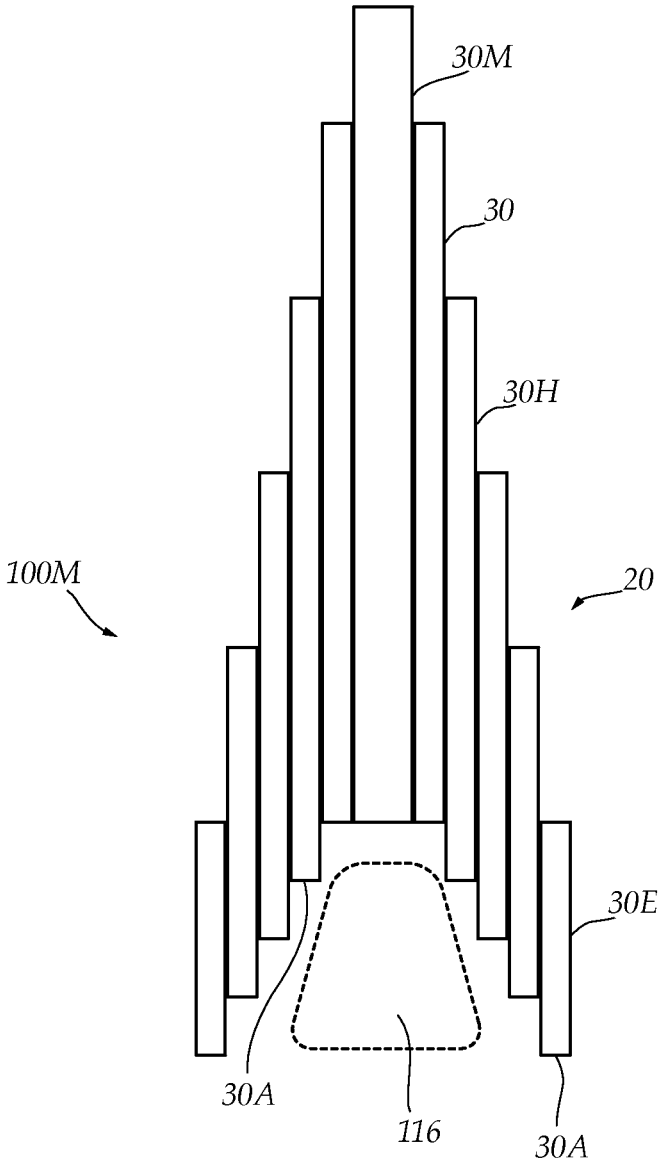
FIG. 6 is a top plan view of a sponsons disposed to accommodate a recessed engine position.

FIG. 6 demonstrates yet another example embodiment of the hull transformation system 20. Only the top plan view of the sponsons are shown for simplicity. The vessel has an engine 116 in a recessed position so that when the vessel is in very shallow water, the vessel is as close to horizontal as possible, requiring that a high horsepower engine having substantial weight be positioned slightly forward toward the fore. The aft ends 30A of the sponsons are not in the same plane but are staggered to accommodate the engine 116. The sponsons raise and lower by attached pneumatic cylinders as explained hereinabove. The sponsons extend in the same manner as described hereinabove. For example, in the flat bottom hull configuration, the bottom of the sponsons are in the same plane. In the V-hull configuration, the bottom of the sponsons are positioned in a staggered manner with the center sponson 30M at the lowest position and the end sponsons only slightly extended, the intermediate sponsons adjacent to the end sponsons extend, the closer the intermediate sponson 30H is to the center sponson, the greater the intermediate sponson 30H extends as described hereinabove.

Figure 14:
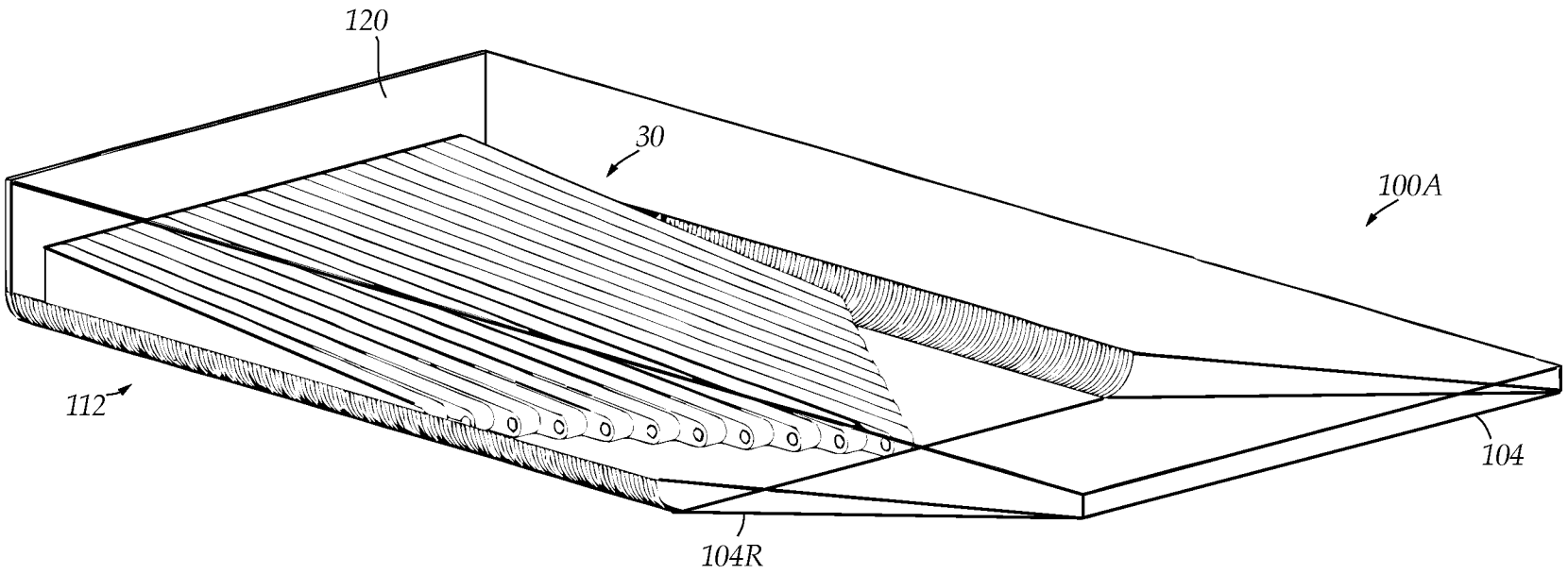
FIG. 14 is a perspective view of an airboat vessel, shown in outline, at rest showing the sponsons forming the hull.

FIG. 14 illustrates yet a further example embodiment of the system for transforming the hull of a vessel. The vessel 100A is an airboat, having the engine 116 and a powerful propeller 114 above a deck of the vessel. The engine powers the propeller and the propeller produces a rearward column of air that propels the airboat forward. The vessel has a rounded chine 112, and a fore that has a section referred to as a rake 104R and a bow 104B. Airboat vessels 100A generally makes wide turns; sharp hard turns sometimes cause the vessel to slide sideways on the rounded chine 112. Airboats are planing vessels and are well known to those of ordinary skill.

In the illustrated example embodiment, the airboat vessel 100A has sponsons 30 for transforming the configuration of the hull. The pneumatic cylinders and controller are not shown for simplicity. In FIG. 14, the sponsons are in the flat bottom hull configuration, the aft ends of the sponsons in the same plane as the transom 120 and the bottom of the sponsons are in the same plane as the transom bottom edge as explained hereinabove. The hull transforms into a V-hull by extended the sponsons 30 below the transom bottom edge in a staggered manner as explained hereinabove.

Figure 15:
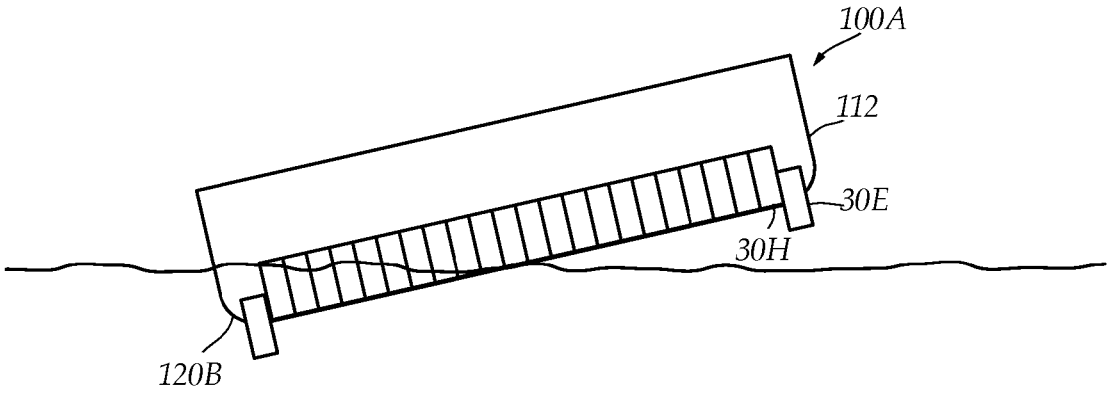
FIG. 15 is a rear elevational view of an airboat vessel with a flat hull making a hard left turn, a pair of end sponsons forming steering rails in a down position.

FIG. 15 illustrates the airboat vessel making a hard left turn to port. In this example embodiment, the configurable hull can transform to stabilize the vessel and prevent sliding. The end sponsons 30E extend below the plane of the transom bottom edge 120B. The extended end sponsons create a tapered edge slightly inboard of the chine so that the hull can grab the water, reducing or preventing sliding during the turn. The end sponsons create a lateral ridge that reduces the traverse slide of the hull during the hard turn.

As explained hereinabove, the controller signals the pneumatic cylinders attached to the end sponsons 30E to extend so that the tapered edge configuration forms rapidly and is available to the user substantially instantly during the execution of the turn. Intermediate sponsons 30H adjacent to the end sponsons 30E are extendable during the turn, as the user requires making the turn more controllable and safer.

Figure 10:
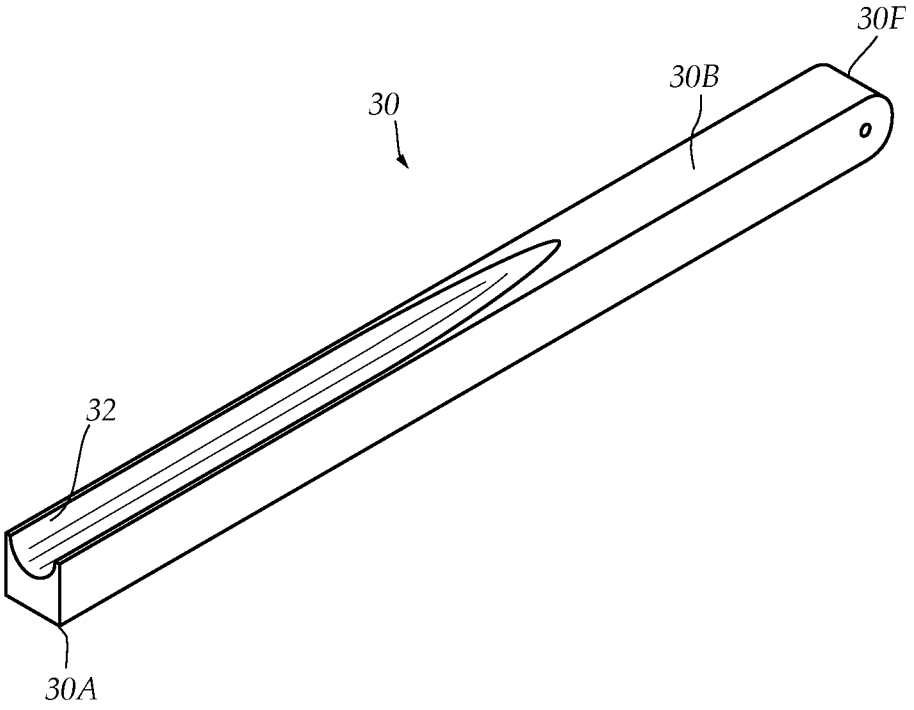
FIG. 10 is a perspective view of an embodiment of a modified sponson of the present disclosure, inverted to show a bottom portion.
Figure 11A:
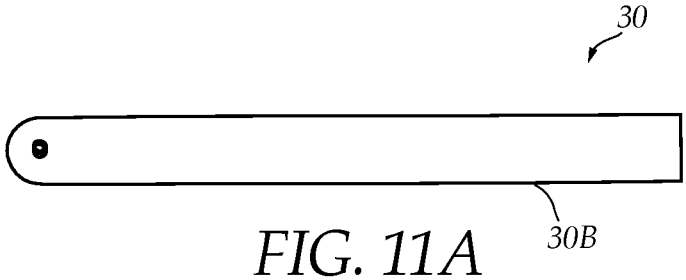
FIG. 11A, FIG. 11B, FIG. 11C and FIG. 11D are further embodiments of the sponson of the present disclosure.

In this discussion, the sponsons generally have a flat bottom 30B as shown in a side elevation in FIG. 11A, but a plurality of other sponson profiles are possible. FIG. 10 shows another example embodiment of the sponson 30, shown in an inverted position to show a bottom portion. In this embodiment, the sponson bottom 30B has a concavity 32 extending from the aft end towards the fore end. When this embodiment is used as the center sponson with a single or twin engines as explained hereinabove, the concavity reduces the raising of the center sponson in the tunnel hull configuration, the concavity 32 creating a top portion of the tunnel opening. The sponson with the cavity of this embodiment is useful in vessels with space limitations under the aft portion of the deck because the sponson does requires less space to raise in order to create the tunnel opening.

Further in this example embodiment, the fore end 30F is wider than the aft end 30A. When the sponson profile is raised when transforming to a tunnel hull or tunnel V-hull configuration, the fore end will gather more water and will collect the water at the aft end to provide a better column of water for the engine propeller to perform in.

Figure 11B:
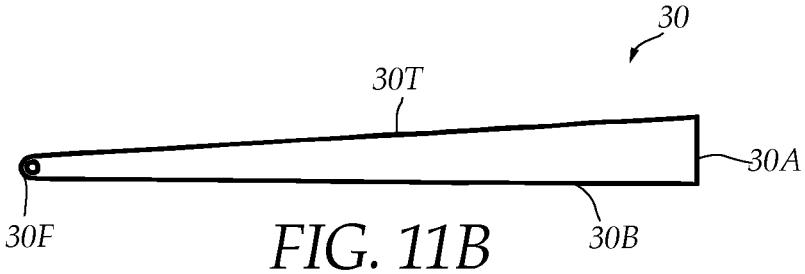
Figure 11C:
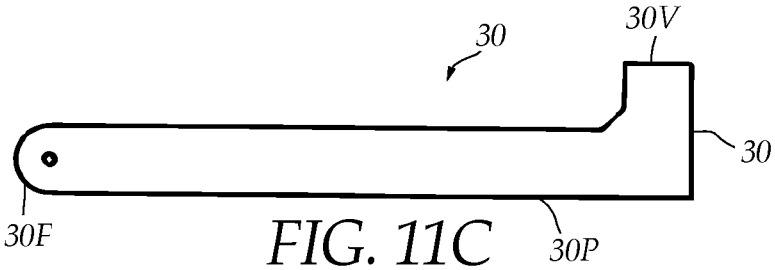
Figure 11D:
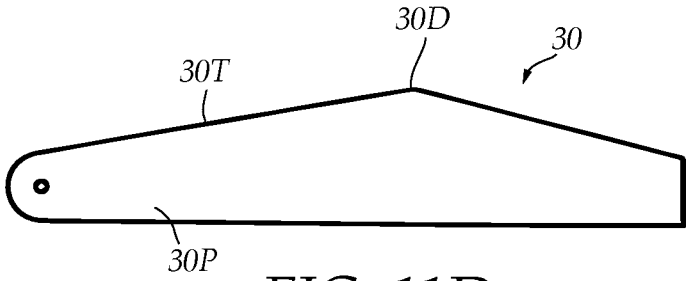

As illustrated in FIG. 11B, FIG. 11C and FIG. 11D other sponson profiles are possible as demonstrated by these non-limiting example embodiments. In FIG. 11B, the sponson 30 has the flat bottom 30B and a top portion 30T tapering from the aft end 30A towards the fore end 30F. In FIG. 11C, the sponson 30 has an aft end 30A with a large vertical portion 30V connecting to a narrow horizontal portion 30P that extends to the fore end 30F. In FIG. 11D, the sponson 30 has a middle portion 30D that extends upward forming an essentially triangular top portion 30T connecting to the vertical portion 30P. It is understood by those of ordinary skill that generally the top portion sponson profile can be formed to accommodate a multiplicity of space limitations, aft deck configurations and strength limitations within the inventive concept. Moreover, any components or materials can be formed from a same, structurally continuous piece or separately fabricated and connected.

Figure 16:
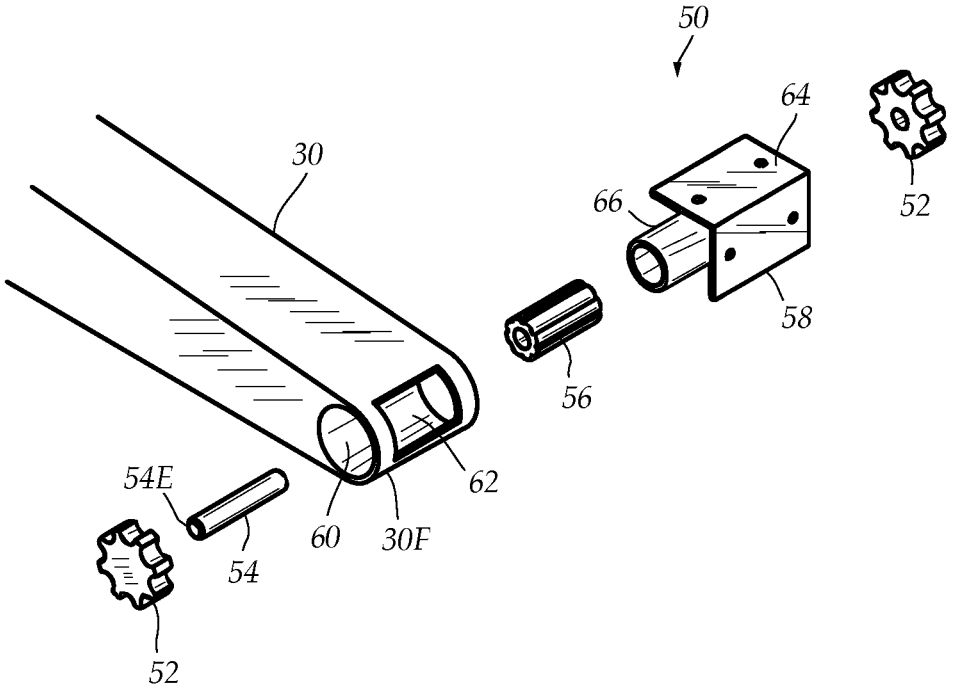
FIG. 16 is an exploded view of an embodiment of a sponson pivot and mount assembly.

FIG. 16 is an exploded view of an embodiment of the sponson fore end 30F showing the pivot and mounting assembly 50 to hingedly connect the sponson 30 to the hull. The fore end 30F has a channel 60 with a window 62 for the pivot and mounting assembly 50. The mount has a bracket having a mounting plate and a cylinder 66 that fits into fore end channel 60, the mounting plate covering the window 62. The bushing 56 fits inside the cylinder and is held by a pin 54 having a pair of ends 54E, the pin placed inside the bushing. The pin is held in place by a pair of caps 52 placed on each end 54E, the pivot and mounting assembly allowing the sponson to pivot into a desired position. It is understood by those of ordinary skill that further embodiments of the assembly are possible within the concepts disclosed herein.

Referring to FIG. 1, the user operates the vessel having the system for transforming the hull vessel with the sponsons in the flat bottom hull configuration in smooth shallow water, essentially floating at rest. The user desires to operate the vessel in shallow water and selects a tunnel hull configuration through the controller. Referring to FIG. 5, the controller signals the pneumatic cylinder 40C attached to the center sponson 30M to completely retract, moving the center sponson clear of the tunnel opening 118 with seconds, substantially instantly while the vessel remains in the water. The user desires to move more quickly in deeper water and desires a V-hull. The users signals the controller and the pneumatic cylinders move the sponsons 20 into the desired staggered manner of a V-hull as the vessel continues moving through the water as shown in FIG. 4. When the vessel returns to shallow water, the user selects a different configuration through the controller and the cylinders respond by moving the sponsons into the desired configuration.

Throughout this disclosure, pneumatic cylinders have been described as positioning the sponsons for transforming the hull. Pneumatic cylinders have actuators that contain compressed air. By regulating the air pressure to the actuators, the pneumatic cylinders absorb the shock of the water and contribute to a smooth ride. Pneumatic cylinders are environmentally safer to use in boating because there is no potential for an oil leak into the water from a damaged cylinder. However, it is understood that hydraulic cylinders are suitable for moving the sponsons in response to the controller without the advantage of absorbing shock or being environmentally friendly. It is further understood that other means of mechanically lowering and raising the sponsons in response to a signal from the controller are possible and such variations are within the inventive concept and contemplated as being a part of the present disclosure.

It is understood that when an element is referred hereinabove as being "on" another element, it can be directly on the other element or intervening elements may be present therebetween. In contrast, when an element is referred to as being "directly on" another element, there are no intervening elements present.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a system of transforming a vessel hull from a first form to another form depending on a plurality of desired vessel operating characteristics. The disclosure is illustrated by example in the drawing figures, and throughout the written description. It should be understood that numerous variations are possible, while adhering to the inventive concept. Such variations are contemplated as being a part of the present disclosure.

What is claimed is:

1. A vessel hull with a controller, an aft portion, and a fore portion, the vessel hull transforming from a first configuration to a second figuration, comprising:

a transom at the aft portion, defining a first plane;

a plurality of integral sponsons forming the hull aft portion, the sponson having a fore end, an aft end, a top and a bottom, the aft end of the sponsons forming a plane substantially parallel and adjacent to the plane defined by the transom, the fore end of the sponsons hingedly connected to a fore hull;

a plurality of pneumatic cylinders, a cylinder attaching to the top of each sponson towards the aft end of the sponson, the pneumatic cylinders signaled by a controller to extend and retract to a selected position, the pneumatic cylinders raising and lowering the sponsons within the plane defined by the transom, substantially instantly transforming a boat hull from a first configuration to a second configuration; and wherein the hull transforms to the second configuration selected from any of a group consisting of flat bottom hull, a V-hull, a tunnel hull and a V-tunnel hull.

2. The vessel hull as described in claim 1, wherein the hull transforms from the first configuration to the second configuration while the vessel remains in the water.

3. The vessel hull as described in claim 2, wherein the hull transforms from a first configuration to a second configuration when the vessel is in motion.

4. The vessel hull as described in claim 3, wherein the transom has at least one tunnel opening to accommodate an engine propeller.

5. The vessel hull as described in claim 4, wherein the sponson inside the tunnel opening is a center sponson and the pneumatic cylinder attached to the center sponson fully retracts the sponson, raising the center sponson above the tunnel opening in the transom, forming the tunnel hull configuration.

6. The vessel hull as described in claim 5, wherein the vessel is a twin-engine having a pair of engines, the transom having two tunnel openings to accommodate the engine propeller for each engine, inside each tunnel opening is a center sponson and the pneumatic cylinder attached to the center sponson fully retracting the sponson, raising the center sponson above the tunnel opening in the transom, forming the twin tunnel hull configuration.

7. The vessel hull as described in claim 5, wherein the vessel has a port side and a starboard side, a pair of end sponsons, an end sponson on the port side and an end sponson on the starboard side, and at least one intermediate sponson between each end sponson and the center sponson, a number of sponsons between the port side end sponson and the center sponson equally the number of sponsons between the starboard side end sponson and the center sponson.

8. The vessel hull as described in claim 7, wherein the transom has a bottom edge further defining a second plane, and the pneumatic cylinders fully retract the end sponsons and the intermediate sponsons, and the pneumatic cylinder attached to the center sponson partially retracts the center sponson such that the bottom of the sponsons are in the same plane as the bottom edge of the transom, forming the flat bottom hull configuration.

9. The vessel hull as described in claim 8, wherein the pneumatic cylinders partially extending the end sponsons and the intermediate sponsons in a staggered manner, such that the end sponsons slightly extend below the bottom edge of the transom, the intermediate sponsons adjacent to the end sponsons extend below the transom bottom edge 120B slightly below the end sponsons, the closer the intermediate sponson is to the center sponson, the greater the intermediate sponson extends below the transom bottom edge, forming a pair of sloped sides of the V-hull below the transom bottom edge and the pneumatic cylinder attached to the center sponson fully extending the center sponson such that the center sponson is completely below the bottom edge of the transom, forming the V-hull configuration.

10. The vessel hull as described in claim 7, wherein the vessel is an airboat having a chine in the flat hull configuration and the end sponsons extend below the plane of the transom bottom edge, created a tapered edge slightly inboard of the chine for stabilizing the vessel and preventing sliding during a hard turn.

11. A system for transforming a vessel hull, the hull having a fore and an aft, from a first configuration to a second figuration, comprising:

a transom at an aft of a hull, defining a plane;

a plurality of integral sponsons forming a vessel aft hull, the sponson having a fore end, an aft end, a top and a bottom, the aft end of the sponsons forming a plane substantially parallel and adjacent to the plane defined by the transom, the fore end of the sponsons hingedly connected to a fore hull;

a plurality of pneumatic cylinders, at least one cylinder attaching to the top of each sponson towards the aft end of the sponson;

a controller that signals the pneumatic cylinders to extend and retract to a selected position, the pneumatic cylinders raising and lowering the sponsons within the plane defined by the transom, substantially instantly transforming a boat hull from a first configuration to a second configuration; and wherein the hull transforms to the second configuration selected from any of a group consisting of flat bottom hull, a V-hull, a tunnel hull and a V-tunnel hull.

12. The system for transforming a vessel hull as described in claim 11, wherein the transom has at least one tunnel opening and having a bottom edge further defining a second plane, the sponsons extending and retracting above the tunnel opening and the bottom edge of the transom, thereby transforming the boat hull from the first configuration to the second configuration.

13. The system for transforming a vessel hull as described in claim 12, wherein the hull transforms from the first configuration to the second configuration while the vessel remains in the water.

14. The system for transforming a vessel hull as described in claim 13, wherein the hull transforms from a first configuration to a second configuration when the vessel is in motion.

15. The system for transforming a vessel hull as described in claim 14, wherein the vessel is a planing vessel.

16. The system for transforming a vessel hull as described in claim 15, wherein the controller is on the deck of the vessel.

17. The system for transforming a vessel hull as described in claim 16, wherein the vessel is selected from the group consisting of a single engine vessel, a twin-engine vessel and an airboat.

18. A method for transforming a vessel hull from a first configuration to a second figuration, the hull having a fore portion, an aft portion, a transom at the aft of the hull, a plurality of integral sponsons hingedly connected to a fore hull forming the aft hull, a plurality of pneumatic cylinders, at least one cylinder attaching to the top of each sponson and a controller signaling the pneumatic cylinders, comprising:

selecting a plurality of pneumatic cylinders to extend or retract through a signal from the controller;

lowering selected sponsons within a plane defined by the transom by extending selected pneumatic cylinders;

raising selected sponsons within the plane defined by the transom by retracting selected pneumatic cylinders, the raised sponsons and lowered sponsons substantially instantly transforming a boat hull from a first configuration to a second configuration; and wherein the hull transforms to the second configuration selected from any of a group consisting of flat bottom hull, a V-hull, a tunnel hull and a V-tunnel hull.

* * * * *